United States Patent [19]

Gershberg et al.

[11] 4,115,781

[45] Sep. 19, 1978

[54] RADIATION ENHANCEMENT DEVICE

[75] Inventors: David N. Gershberg, Rockville, Md.; Alexander Y. Lee, Arlington, Va.; Michael D. D'Orto, Hyattsville, Md.

[73] Assignee: E-Systems, Inc., Dallas, Tex.

[21] Appl. No.: 805,448

[22] Filed: Jun. 10, 1977

[51] Int. Cl.[2] ..... H01Q 3/26

[52] U.S. Cl. ..... 343/768; 333/84 L

[58] Field of Search ..... 343/768, 767, 771; 333/84 L, 84 R

[56] References Cited

U.S. PATENT DOCUMENTS

| | | | |
|---|---|---|---|
| 3,593,143 | 7/1971 | Nakahara et al. | 343/768 |
| 3,963,999 | 6/1976 | Nakajima et al. | 343/771 |
| 3,995,274 | 11/1976 | Schwartz et al. | 343/771 |

*Primary Examiner*—Alfred E. Smith
*Assistant Examiner*—David K. Moore
*Attorney, Agent, or Firm*—Robert V. Wilder

[57] ABSTRACT

A resonant radiation assembly for RF transmission lines is provided wherein the coupling level between the assembly and the transmission line may be readily adjusted at any point along the longitudinal axis of the line. The outer conductor of a coaxial transmission line is partially milled to provide radiation slots along the line, and the conductor is sheathed in a polyethylene cable jacket. A section of dielectric tubing is longitudinally gapped. Either plural conductive strips in combination with a transversely oriented radiation loop, or a single conductive strip is bonded to the outer surface of the tubing opposite the gap. The tubing is placed over the jacket and translated along the line to the desired operating location. The RF coupling level may be adjusted by rotating the tubing about the transmission line to vary the degree of coincidence between the conductive strip and the radiation slots. When the single conductive strip is used, a spatial energy pattern is provided which is primarily polarized along the longitudinal axis of the transmission line. The energy pattern is predominantly polarized in a direction normal to the line, however, when plural strips are used in combination with one or more radiation loops.

23 Claims, 7 Drawing Figures

RADIATION ENHANCEMENT DEVICE

FIELD OF THE INVENTION

The invention relates to slotted coaxial transmission lines having resonant radiation assemblies for enhancing the level of RF energy coupled from the center conductor to the surrounding free space.

PRIOR ART

In RF (radio frequency) communication systems, free space paths are required between a transmitter and a receiver. Where buildings or other impasses interrupt the communication path, resort has been had to RF transmission lines which may carry the RF energy around such impasses. U.S. Pats. Nos. 2,408,435 and 3,524,190 collectively disclose transmission lines having a plurality of regularly spaced orifices along the length of the lines, and antenna structures coupled through the orifices to internal RF conductors to radiate the RF energy and thereby complete the communication link. The antenna structures may be dipole element or loop element radiators. The orifice size, the separation between the orifices, and the diameter of the transmission line may be controlled to radiate wave energy of a predetermined frequency.

An improvement to transmission line antenna structures was the advent of the concept of leaking RF energy from the central conductor, and through the outer conductor to a radiation enhancement device. U.S. Pat. No. 3,699,582 discloses a coaxial transmission line wherein the outer conductor is separated at a plurality of points along the line to expose the central conductor. The longitudinal distance between the separations varies along the line to provide a predetermined phase distribution of radiation currents. A radiation assembly comprising a metal sleeve supported by insulators surrounds the outer conductor at each separation point to act as a capacitive shunt. Further, U.S. Pat. No. 3,947,834 discloses a coaxial transmission line wherein the outer conductor includes spaced groups of radiation slots rather than total conductor separations. Energy transfer between the outer and central conductors is enhanced by placing a thin conducting sleeve around the outer cable jacket in coincidence with the radiation slots.

The above-described antenna structures do not provide a readily adjustable means for varying the coupling level between the internal traveling wave and the external free space. By way of contradistinction, each of the heretofore used radiation assemblies have been fixed in place or have required a modification to the transmission line to vary the coupling level. Further, no provision has been made for readily changing the location of radiation enhancement devices along the transmission line.

The present invention provides a resonant radiation assembly wherein the coupling level is readily adjustable, and may be translated along the length of the transmission line to enhance radiation patterns at selected locations without modification to the line.

SUMMARY OF THE INVENTION

A radiation enhancement assembly is provided for a coaxial transmission line having radiation slots spaced along the longitudinal axis of the outer conductor, wherein the coupling level between the center conductor and free space is readily adjustable. In addition, the assembly may be translated along the transmission line to enhance the spatial radiation pattern at selected points without modifying the line.

More particularly, the radiation assembly is comprised of a section of dielectric tubing which is separated along its longitudinal axis, and placed over the outer cable jacket in coincidence with the radiation slots. The inner diameter of the assembly is slightly less than the outer diameter of the cable jacket to provide a gripping force. The radiation assembly readily may be translated along the transmission line, and rotated about the cable jacket to vary the level of coupling between the assembly and the center conductor.

In one aspect of the invention, a half wavelength conductive strip is bonded to the outer surface of the radiation assembly opposite the tube separation to provide a longitudinally polarized energy wave.

In a further aspect of the invention, two spaced apart and colinear quarter wavelength conductive strips are applied to the outer surface of the radiation assembly opposite the longitudinal separation. The conductive strips respectively couple energy to opposing ends of the transversely oriented conducting loop, which is open-circuited by a dielectric spacer adjacent the longitudinal tube separation. When two such radiation assemblies are placed end to end with the loops connected for 180° phasing, the longitudinally polarized energy wave is attenuated while the transversely polarized wave is enhanced.

In a still further aspect of the invention, two parallel quarter wavelength conductive strips are bonded to the outer surface of the radiation assembly opposite the longitudinal tube separation. The conductive strips respectively couple energy to opposing ends of a transversely oriented conducting loop, which is open-circuited by a dielectric spacer adjacent the longitudinal separation of the tube section. The parallel conductive strips are spaced about the circumference of the tube section to attenuate the longitudinal polarized energy wave while enhancing the transversely polarized wave.

DESCRIPTION OF THE DRAWINGS

For a more complete understanding of the present invention and for further objects and advantages thereof, reference may now be had to the following description taken in conjunction with the accompanying drawings in which.

DESCRIPTION OF THE PREFERRED EMBODIMENTS

Figure 1:
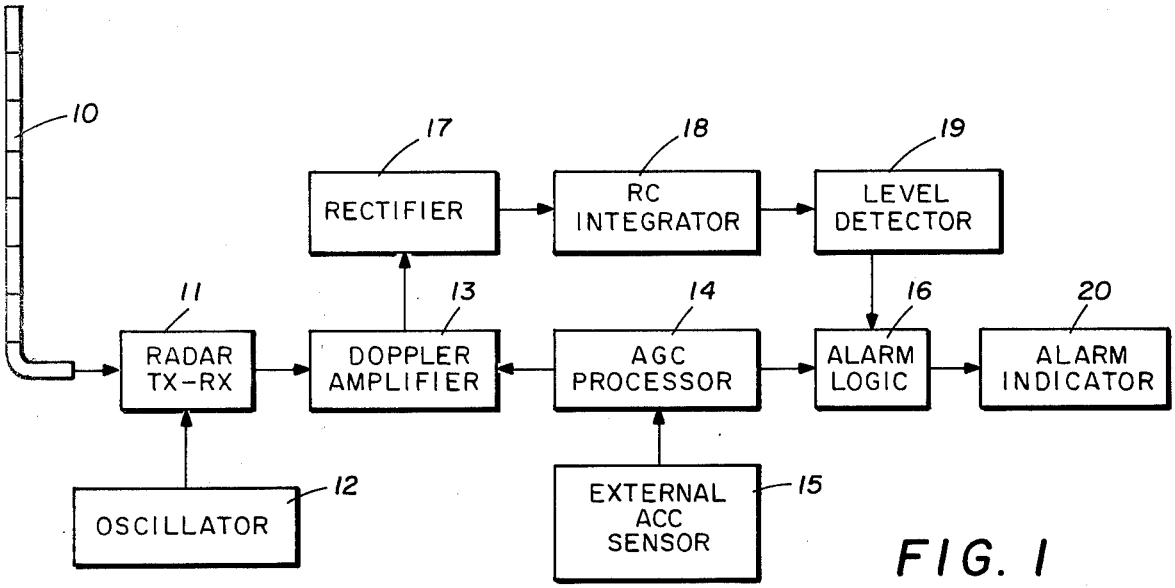
FIG. 1 is a block diagram of a single channel doppler intrusion alarm system utilizing a flexible distributed antenna in accordance with the invention.

FIG. 1 illustrates in block diagram form a microwave intrusion alarm system including a sensing antenna 10 comprised of a coaxial transmission line.

The antenna 10 transmits energy from and reflects energy to a transmit/receive transceiver 11, which is coupled to a microwave frequency oscillator 12. A reflected or doppler frequency signal from the transceiver 11 is applied to a doppler amplifier 13 having an automatic gain control network (not shown) in accordance with usual design practices. The automatic gain control network of the doppler amplifier 13 is activated in accordance with the output of an AGC processor 14 having an input coupled to an external AGC sensor 15.

The external AGC sensor 15 detects environmental noise in the vicinity of the antenna 10. Examples of ambient conditions which provide such noise signals are vibrations, wind pressure, rain, and movement of large objects. When the noise signals are sensed by the sensor 15, the processor 14 is activated to reduce the gain of the doppler amplifier 13. Excessive output signals from the sensor 15 also cause the processor 14 to drive an alarm logic unit 16 to be further described. Any attempt to desensitize the system with large signal noise jamming thus will initiate an alarm.

Signals from amplifier 13 also are applied to a rectifier 17 which develops a unidirectional voltage from the doppler signals. The output of the rectifier 17 is applied to an RC integrator 18 for amplification and smoothing. When the output of the integrator reaches a predetermined DC level, a level detector 19 is triggered to activate the alarm logic unit 16. In response thereto, an alarm indicator 20 is energized.

Figure 2:
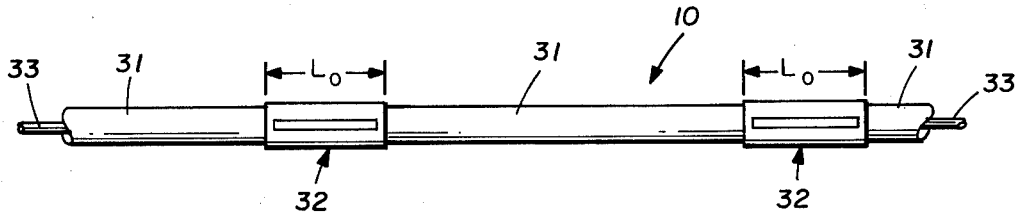
FIG. 2 is a pictorial view of a coaxial transmission line with resonant strip radiation assemblies for enhancing longitudinally polarized energy waves in accordance with the invention.
Figure 3:
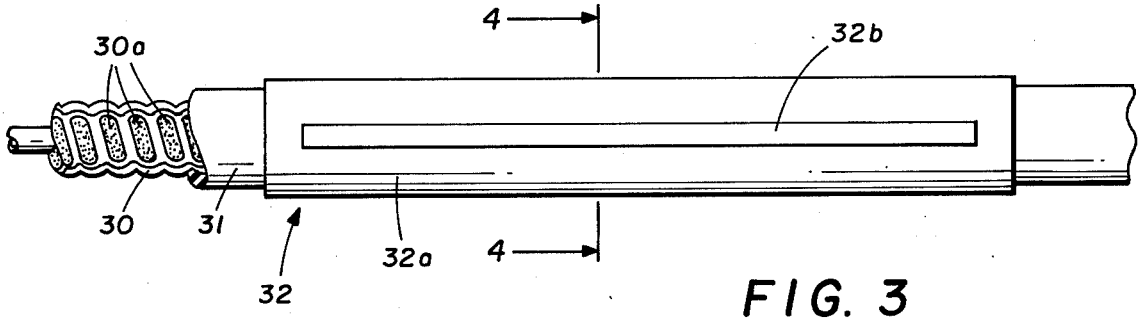
FIG. 3 is a pictorial view of the coaxial transmission line of FIG. 2 with the cable jacket partially cut away to expose the slots in the outer conductor of the transmission line.

FIGS. 2 and 3 are detailed pictorial views of the antenna 10 with portions of the cable jacket and outer conductor cut away to expose a central conductor and radiation slots in the outer conductor. More particularly, antenna 10 is comprised of a coaxial transmission line having an outer conductor 30 which is partially milled to provide the radiation slots 30*a*. The outer conductor is sheathed in a polyethylene cable jacket 31. Resonant radiation assemblies 32 each are placed around the cable jacket over the slots 30*a*, and are spaced apart according to their desired operating locations. An assembly 32 is comprised of a section of longitudinally separated dielectric tubing 32*a*. The internal diameter of the tube section is slightly less than the outer diameter of the cable jacket 31 to provide a gripping pressure. A conductive strip 32*b* is applied to the outer surface of the tubing opposite the longitudinal separation. The conductive strip is approximately one-half wave in length in order to provide a maximal energy coupling at the selected frequency of radiation.

In operation, RF energy is applied to the center conductor 33. As a traveling wave of RF energy passes the slots 30*a*, part of the energy couples through the slots to the radiation assembly 32. The conductive strip 32*b* operates in a resonant mode to produce a radiation pattern primarily polarized in a direction parallel to the longitudinal axis of antenna 10. The coupling level between the center conductor 33 and the conductive strip 32*b* readily may be adjusted by rotating the radiation assembly 32 about jacket 31. The degree of coincidence between the slots 30*a* and the conductive strip thereby may be varied. Further, in the event that radiation patterns from localized sections of antenna 10 are to be enhanced, the radiation assembly 32 may be translated along the jacket 31 to any desired location. No further modification to the coaxial transmission line is required.

Figure 4:
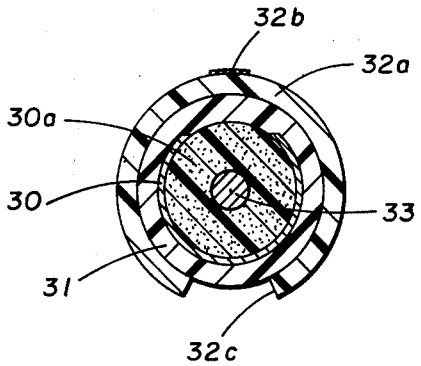
FIG. 4 is a cross sectional view of the transmission line of FIG. 3 taken along lines 4—4.

The interaction between center conductor 33 and the radiation assembly 32 may be better understood by reference to FIG. 4, where antenna 10 is illustrated in cross section. The assembly 32 is concentric with the polyethylene jacket 31, and the conductive strip 32*b* is in vertical alignent with slots 30*a*. The longitudinal separation 32*c* of the tube section 32*a* provides a gripping pressure to maintain contact between the radiation assembly and the jacket 31. When an excitation frequency is applied to the center conductor 33 part of the traveling wave energy is coupled through the slots 30*a* to the conductive strip 32*b*. If the conductive strip is of a resonant length, the coupling level between conductor 33 and strip 32*b* is maximized. The coupling level may be adjusted by rotating the strip 32*b* with respect to the jacket 31, thereby varying the degree of coincidence between the strip and the slots 30*a*.

Figure 5:
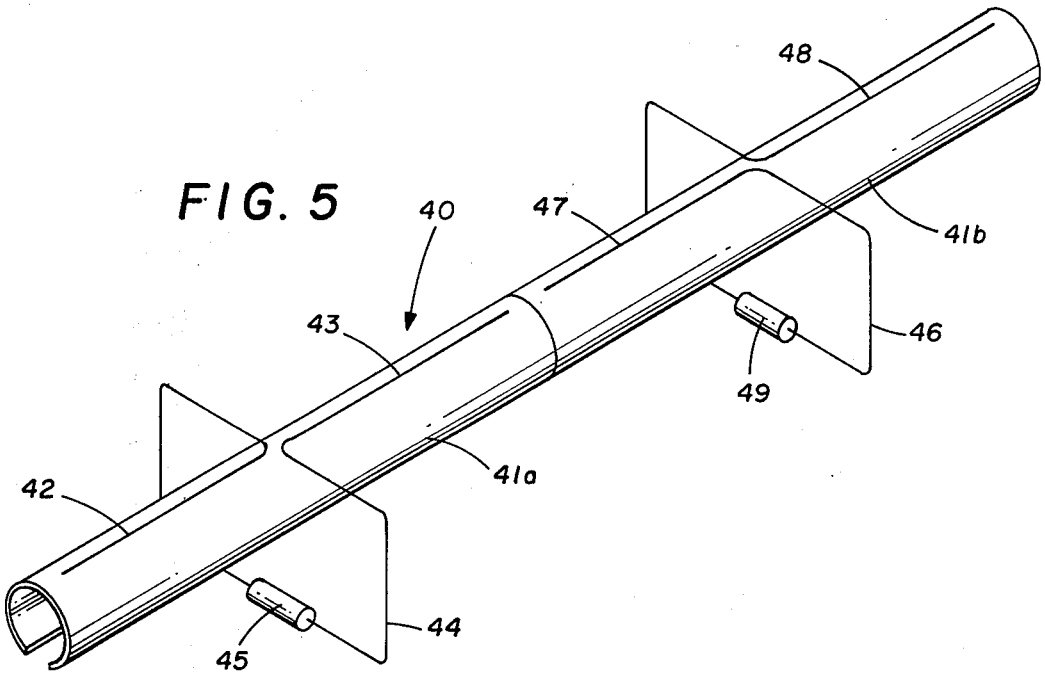
FIG. 5 is an isometric view of end to end transverse loop radiation assemblies for enhancing transversely polarized energy waves in accordance with the invention.

In the event that transverse polarization rather than longitudinal polarization is desired to avoid "cutoff" when radiating from a concrete trough, a transverse loop radiation assembly may be used as illustrated in FIG. 5.

A dual loop radiation assembly 40 is comprised of two longitudinally gapped dielectric tubes 41*a* and 41*b*. Conductive strips 42 and 43 are bonded to the outer surface of the tube 41*a* opposite the longitudinal gap. Each of the conductive strips or leads couple energy to a loop radiator 44 which is transverse to the tube 41. The loop radiator is approximately one-half wavelength in circumference, and is open-circuited adjacent the longitudinal gap by means of a dielectric spacer 45. A second loop radiator 46 is energized in like manner but at 180° phasing by conductive strips 47 and 48. As before, the loop radiator is approximately one-half wavelength in circumference, and open-circuited by means of a dielectric spacer 49.

With the loop radiators spaced apart one from the other a distance of about a half wavelength, the longitudinally polarized components of the energy waves from the conducting strips are approximately 180° out of phase and tend to cancel. The transversely polarized components from the loops add together because of the 180° phasing and are therefore enhanced.

Figure 6:
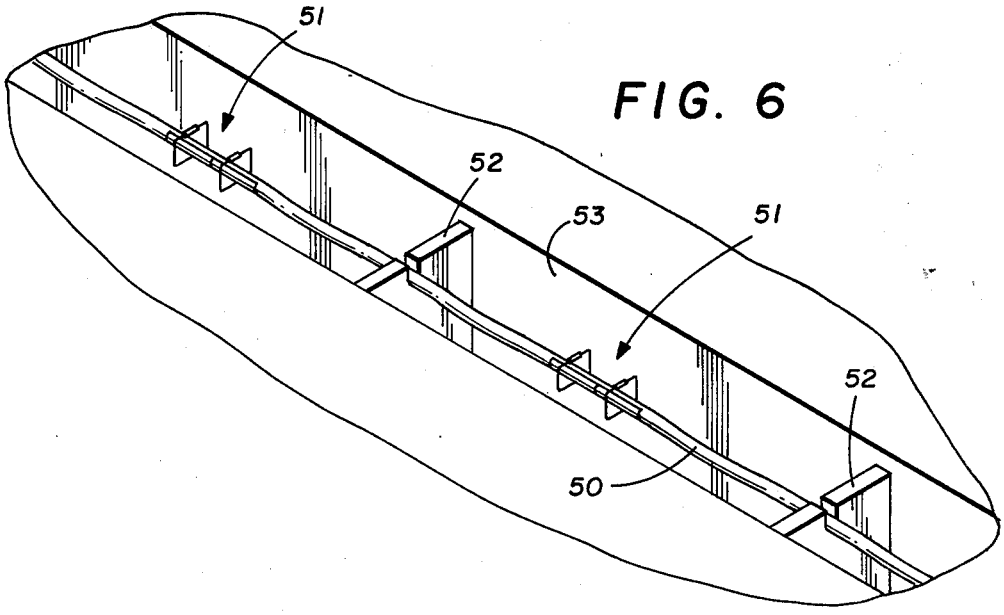
FIG. 6 is a pictorial view of a surface level coaxial transmission line employing the transverse loop radiation assemblies of FIG. 5.

FIG. 6 illustrates pictorially a coaxial transmission line 50 having dual loop radiation assemblies 51. The coaxial line is supported by cross members 52 slightly below the surface of the earth within a concrete lines trough 53. Between each pair of cross members, an assembly 51 is placed over the outer cable jacket of the transmission line. The coupling level for each assembly may be adjusted by rotating the assembly about the transmission line, thereby radiating an energy wave primarily polarized in a direction normal to the transmission line. Hence, "cutoff" due to the concrete lined trough is avoided.

Figure 7:
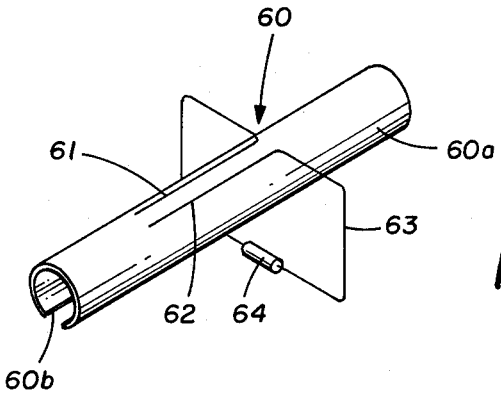
FIG. 7 is an isometric view of a second embodiment of a transverse loop radiation assembly in accordance with the invention.

Referring to FIG. 7, a single loop radiation assembly 60 is illustrated for providing a transversely polarized energy wave. More particularly, two conductive strips 61 and 62 are bonded in parallel to the outer surface of a dielectric tube section 60*a*. The conductive strips each are approximately a quarter wavelength and are spaced sufficiently so that one strip may lie over the coupling slots while the parallel strip lies over the solid portion of the cable's outer conductor. The strip over the slots serves as the active coupling element to the loop, while the second strip acts as a low impedance "current sink" back to the surface of the cable. The circumference of the loop is approximately a half wavelength. A longitudinal gap 60*b* is formed in the tube section opposite the conductive strips, and the loop radiator is open-circuited by means of a dielectric spacer 64 adjacent the gap.

The longitudinally polarized radiation components from the strips tend to cancel because of their close parallel spacing in terms of the operating wavelength and because the strip currents are approximately equal and 180° out of phase. Hence, two pairs of strips are not required to provide cancellation, as was the case for the dual loop configuration described previously.

In operation, the radiation assembly 60 is placed over the outer dielectric jacket of a coaxial transmission line. The outer conductor of the line is slotted to provide a communication path between the center conductor and the radiation assembly. When RF energy is applied to the center conductor, the conductive strips 61 and 62 operate in the resonant mode to couple energy to the radiation loop 63. When the conductive strips separated as before described, the longitudinally polarized component of the energy wave radiated by the strips is attenuated while the transversely polarized component from the loop is enhanced.

While specific embodiments of the invention have been described in detail, it is to be understood that variations and modifications obvious to one of ordinary skill may be made without departing from the spirit and scope of the present invention as defined in the appended claims.

What is claimed is:

1. In a radiation enhancement system for a coaxial transmission line having a center conductor and an outer conductor with longitudinally spaced radiation slots, the combination which comprises:

(a) a dielectric tube partially encircling and slidably positionable along the transmission line; and (b) conductive element bonded to the outer surface of said dielectric tube for movement therewith to enhance the orthogonally polarized component of energy coupled from said center conductor through said radiation slots.

2. In a system for enhancing longitudinally polarized energy coupled from a center conductor through radiation slots formed in an outer conductor of a coaxial transmission line, the combination which comprises:

(a) a dielectric tube encircling and slidably positionable along the said transmission line; and (b) a conductive strip of resonant length bonded to the outer surface of said tube for movement therewith to enhance the longitudinally polarized energy.

3. In a radiation enhancement system for a coaxial transmission line including a center conductor, an outer conductor having radiation slots longitudinally spaced along its longitudinal axis, and a dielectric cable jacket, the combination which comprises:

(a) a dielectric tube slidably encircling said jacket and overlaying said radiation slots;

(b) a first pair of colinear conductive strips bonded to the outer surface of said tube;

(c) a first open-circuited radiation loop in electrical communication with and intermediate to said first pair in a plane normal to said transmission line;

(d) a second pair of conductive strips colinear with said first pair and bonded to the outer surface of said tube; and (e) a second open-circuited radiation loop in electrical communication with and intermediate to said second pair in a plane parallel to said first loop.

4. The combination set forth in claim 3, wherein each of said first and said second pair of conductive stris are of a quarter wavelength at the radiation frequency, and said first and said second loops are a half wavelength in circumference.

5. The combination set forth in claim 3, including a pair of dielectric spacers respectively separating said first and said second loops adjacent the outer surface of said tube opposite said first and said second pair.

6. In a system for enhancing transversely polarized energy coupled from a center conductor of a coaxial transmission line having an outer conductor with radiation slots formed therein, and an outer dielectric cable jacket, the combination which comprises:

(a) a dielectric tube slidably encircling said cable jacket;

(b) a pair of circumferentially separated and parallel conductive strips bonded to the outer surface of said tube; and (c) an open-circuited radiation loop in electrical communication with said pair and encircling said tube in a plane normal to said transmission line.

7. The combination set forth in claim 6, wherein said pair extends a quarter wavelength at the radiated frequency along the longitudinal axis of said transmission line.

8. A method of controlling the level of radiated energy coupled from a center conductor of a coaxial transmission line having an outer conductor with longitudinally spaced slots covered by dielectric cable jacket, which comprises:

bonding a conductive radiation member having the desired polarization characteristics to the outer surface of a section of dielectric material;

positioning on said jacket the section of dielectric material; and rotating said section about the transmission line to vary the level of coincidence between the radiation member and said slot.

9. A method of fabricating a system for enhancing a transversely polarized component of energy radiated by a coaxial transmission line having a center conductor and an outer conductor with longitudinally spaced radiation slots encompassed by an outer dielectric jacket, which comprises:

(a) forming a first conductive lead and a first transverse loop half from a first conductive strip;

(b) forming a second conductive lead and a second transverse loop half from a second conductive strip;

(c) slidably encircling said jacket with a section of dielectric material;

(d) bonding said first and said second conductive leads in parallel relation to the outer surface of said section; and (e) interconnecting said first and said second loop halves with a dielectric spacer to form an open-circuited radiation loop encircling said section in a plane normal to said transmission line.

10. The method set forth in claim 9 including the following steps for tuning said radiation assembly:
(a) circumferentially spacing said first and said second conductive leads to enhance said transverse component and attenuate longitudinal components of radiated energy;
(b) translating said section along said transmission line to any desired location; and
(c) rotating said section about said transmission line to vary the level of coincidence between said first and said second conductive leads and said radiation slots.

11. A method of fabricating a dual-loop radiation system for enhancing a transversely polarized component of energy radiated by a coaxial transmission line having a center conductor and an outer conductor with longitudinally spaced radiation slots encompassed within a dielectric cable jacket, which comprises:
(a) slidably encircling said jacket with a section of dielectric material;
(b) forming a first conductive lead and a first radiation loop half from a first conductive strip;
(c) forming a second conductive lead and a second radiation loop half from a second conductive strip;
(d) bonding said first and said second leads in colinear relation to the outer surface of said section;
(e) interconnecting said first and said second radiation loop halves with a dielectric spacer to form a first open-circuited radiation loop encircling said section in a plane normal to said transmission line; and
(f) repeating steps (b) through (e) to form a second open-circuited radiation loop parallel to and spaced a half wavelength from said first loop at the radiation frequency and fed at 180° phasing with respect to the first loop.

12. The method set forth in claim 11 including the following steps for tuning said dual-loop radiation system:
(a) translating said section along said transmission line to any desired location; and
(b) rotating said section about said transmission line for the required level of energy coupling between said dual-loop radiation system and said center conductor.

13. A method of fabricating a resonant radiation system for enhancing a longitudinally polarized component of energy radiated from a coaxial transmission line with an outer conductor having longitudinally spaced radiation slots, which comprises:
(a) bonding a conductive strip of resonant length to the outer surface of a section of dielectric material; and
(b) slidably positioning on said transmission line the section of dielectric material.

14. The method set forth in claim 13, including the steps of:
(a) translating said section along said transmission line to any desired location; and
(b) rotating said section about said transmission line to vary the level of coincidence between said conductive strip and said slots.

15. A system for enhancing the longitudinally polarized component of an energy wave radiated by a coaxial transmission line, which comprises:
(a) an outer conductor of said transmission line having longitudinally spaced radiation slots;
(b) a dielectric jacket encircling said outer conductor;
(c) a dielectric tube gapped along its longitudinal axis and slidably mating concentrically with said jacket; and
(d) a conductive strip of resonant length bonded to the outer surface of said tube parallel to the longitudinal axis of said transmission line.

16. A system for enhancing a transversely polarized component of energy radiated by a coaxial transmission line, which comprises:
(a) an outer conductor of said transmission line having longitudinally spaced radiation slots formed therein;
(b) a dielectric jacket encircling said outer conductor;
(c) a dielectric tube slidably encircling said jacket and having a longitudinal gap;
(d) a first radiation loop means bonded to the outer surface of said tube opposite said gap; and
(e) a second radiation loop means bonded to the outer surface of said tube contiguous to said first loop means for radiating an energy wave substantially polarized in a direction transverse to said transmission line.

17. The combination set forth in claim 16, wherein each of said first and said second loop means includes:
(a) a first conductive strip having a first member parallel to the longitudinal axis of said tube and a second member in the shape of a half loop in a plane transverse to said tube;
(b) a second conductive strip having a third member colinear with said first member and a fourth member in the shape of a half loop in opposing relation with said second member; and
(c) a dielectric spacer connected to said second member and said fourth member at points adjacent to said gap.

18. The combination set forth in claim 17, wherein each of said first, second, third and fourth members are a quarter wave in length at the radiation frequency.

19. A system for enhancing a transversely polarized component of energy radiated by a coaxial transmission line, which comprises:
(a) an outer conductor of said transmission line having longitudinally spaced radiation slots formed therein;
(b) a dielectric cable jacket overlaying and concentric with said outer conductor;
(c) a dielectric tube slidably encircling said jacket and gapped along its longitudinal axis;
(d) a first conducting means bonded to the outer surface of said tube opposite said gap;
(e) a second conducting means bonded to the outer surface of said tube in parallel relation with said first conducting means; and
(f) a dielectric spacer interconnecting said first and said second conducting means to form an open-circuited radiation loop encircling said transmission line in a plane normal to said tube.

20. The combination set forth in claim 19 wherein the circumference of said loop is a half wavelength at the radiating frequency.

21. A system for enhancing a transversely polarized component of energy radiated by a coaxial transmission line having a center conductor and an outer conductor with longitudinally spaced radiation slots encompoassed by an outer dielectric jacket which comprises:
a first conductive lead and first transverse loop half formed from a first conductive strip;

a second conductive lead and a second transverse loop half formed from a second conductive strip;

a section of dielectric material slidably encircling the outer dielectric jacket;

the first and second conductive leads bonded to the outer surface of said section; and means for interconnecting said first and second loop halves with a dielectric spacer to form an open-circuited radiation loop encircling said section in a plane normal to the transmission line.

22. A system for enhancing a transversely polarized component of energy as set forth in claim 21 wherein said first and second conductive leads are bonded in a parallel relationship to the outer surface of said section.

23. A system for enhancing a transversely polarized component of energy as set forth in claim 21 wherein said first and second conductive strips are bonded in a colinear relationship to the outer surface of said section.

* * * * *